United States Patent [19]

Paulus, Jr.

[11] 3,934,803

[45] Jan. 27, 1976

[54] BAG DISTENDING AND SUPPORTING APPARATUS

[75] Inventor: Lawrence Frederick Paulus, Jr., Pleasantville, N.Y.

[73] Assignees: Lawrence Frederick Paulus, Jr.; Gordon Asch; Mark T. Basseches, all of Pleasantville, N.Y.

[22] Filed: Oct. 8, 1974

[21] Appl. No.: 513,109

[52] U.S. Cl. ..... 248/99; 15/257.1; 150/49; 294/1 R

[51] Int. Cl.[2] ..... B65F 1/04; B65B 67/12

[58] Field of Search ..... 294/1 R, 19 R, 55; 15/104.8, 257.1, 257.4, 257.8, 257.9; 56/400, 13; 150/1, 2, 49; 248/46, 95, 97–101, 147, 164, 166, 431

[56] References Cited

UNITED STATES PATENTS

| | | | |
|---|---|---|---|
| 868,269 | 10/1907 | Hulbert | 248/100 |
| 1,971,642 | 8/1934 | Champlin | 248/97 |
| 2,189,687 | 2/1940 | Thomas | 248/46 |
| 3,744,081 | 7/1973 | Miller | 15/257.1 |
| 3,779,496 | 12/1973 | Welles | 248/99 |

*Primary Examiner*—Evon C. Blunk
*Assistant Examiner*—Johnny D. Cherry
*Attorney, Agent, or Firm*—Mark T. Basseches; Paula T. Basseches

[57] ABSTRACT

The present invention relates to a portable bag distending and supporting apparatus for holding a bag, such as a plastic leaf collector or trash collector, with the receiving end thereof in open position essentially perpendicular to a horizontal surface, thus to permit leaves and trash to be raked or swept into the interior of the bag. The device is characterized by a support mechanism which holds the receiving end of the bag against tilting without requiring the use of stakes or spikes embedded in the ground, the support apparatus in addition functioning at least partially to extend the bag in a lengthwise direction to facilitate filling. The device is further characterized by being constructed of inexpensive components which may be readily assembled by the user, thus reducing the bulk of the apparatus in shipping.

9 Claims, 4 Drawing Figures

BAG DISTENDING AND SUPPORTING APPARATUS

BACKGROUND OF THE INVENTION

1. Field of the Invention

The present invention lies in the field of refuse and leaf collection, and more particularly relates to an attachment for use in conjunction with conventional plastic leaf bags or the like, whereby the bags are maintained on a horizontal surface, such as a lawn, pavement, floor, with the open end of the bag disposed in a vertical plane to permit ready filling of the bag by a rake, sweeper, etc.

2. The Prior Art

Recently, plastic bags, particularly vinyl plastic bags, have found increasing use as collectors and receptacles for leaves, trash and the like. In certain applications, such as leaf collection, bags are typically filled by manually retaining the bag mouths in a vertical plane and sweeping or raking the leaves into the bag mouth.

In order to facilitate bag filling, numerous concepts have been advanced for maintaining the bag in open position so that the operator may concentrate his attention on forcing the leaves or other material into the bag rather than on maintaining the bag in the desired position for filling. As examples of such bag holders, reference may be made to the following U.S. Pat. Nos.: 3,135,984; 3,604,677; 3,627,243; 3,697,030; 3,744,081; 3,747,653 and 3,754,785. Each of the noted patents purports to relate to a bag attachment for facilitating the filling thereof. However, each of the patents fails in one or more of the following aspects: requiring the use of stakes or spikes to be driven into the ground as the means for supporting the bag, and hence being unuseable on hard surfaces; employing complex and therefore expensive parts and components; requiring manual or foot manipulation to support the bag mouth in open position; providing no means for assuring that the bag will be distended in a lengthwise direction; and involving substantial bulk so that the units must be encased in relatively large cartons for shipping and occupy sustantial storage space when not in use.

SUMMARY

The present invention may be summarized as directed to an improved bag holding apparatus for supporting a bag on a horizontal surface, such as a lawn, pavement or floor, without the requirement of utilizing stakes, spikes or the like, the holder being constructed of inexpensive, readily available plastic material, being susceptible of shipping in "knocked down" form, in which form it occupies only a very limited space, and being readily assemblable for use and collapsible when not in use.

The apparatus is, in addition, functionally superior to devices heretofore known in that the mechanism which supports the parts so that the bag opening remains in a vertical plane for filling also distends or extends the bag in a horizontal direction, facilitating filling of the bag by assuring that the pliable bag material will not gather, lie, or bunch in blocking position of the open bag mouth.

The apparatus includes a base portion which supports a stretcher assembly adapted to expand the mouth of the bag so that the same conforms to the configuration of the base and stretcher. A support blade is provided adjacent and above the base, the blade being pivotal in a plane parallel to the plane of the base such that its longitudinal axis may be aligned with or displaced from the axis of the base. When the blade is pivoted such that its longitudinal axis is displaced from the longitudinal axis of the base plate, preferably at a 90° angle, the blade supports the base plate and, hence, the open mouth of the bag, against tilting from the vertical plane, a portion of the stretcher blade entering into the interior of the bag to assure that portions of the bag toward the closed end cannot block the open mouth.

In accordance with an embodiment of the invention, the components, notably base plate, blade and stretcher, may all be formed of thin planar resilient plastic elements, reducing the cost of the apparatus to a price sufficiently low to permit its being used, for instance, as a premium or give-away item to purchasers of the bags.

In accordance with an embodiment, certain of the parts may be integrally formed or may be defined of snap-together construction.

It is accordingly an object of the invention to provide an improved bag distending support member for holding trash bags or the like on a horizontal surface with the bag mouth open, to facilitate the introduction of detritus, leaves, etc., thereinto.

A further object of the invention is the provision of a device of the type described wherein the apparatus not only retains the bag in position thereon and retains the mouth of the bag in a vertical plane, but also extends or distends the bag in the longitudinal direction.

Still a further object of the invention is the provision of a device of the type described wherein insertion of the bag onto, and removal of the bag from, the apparatus may be rapidly effected.

Still a further object of the invention is the provision of a bag support apparatus of the type described wherein the tilt-resistant mounting of the bag on a horizontal surface is accomplished without the necessity for driving pegs, spikes, etc. into the surface.

Still a further object of the invention is the provision of a device of the type described wherein the components are fabricated of resilient plastic elements, making for a light weight, inexpensive construction.

To attain these objects and such further objects as may appear herein or be hereinafter pointed out, reference is made to the accompanying drawings, forming a part hereof, in which.

Figure 1:
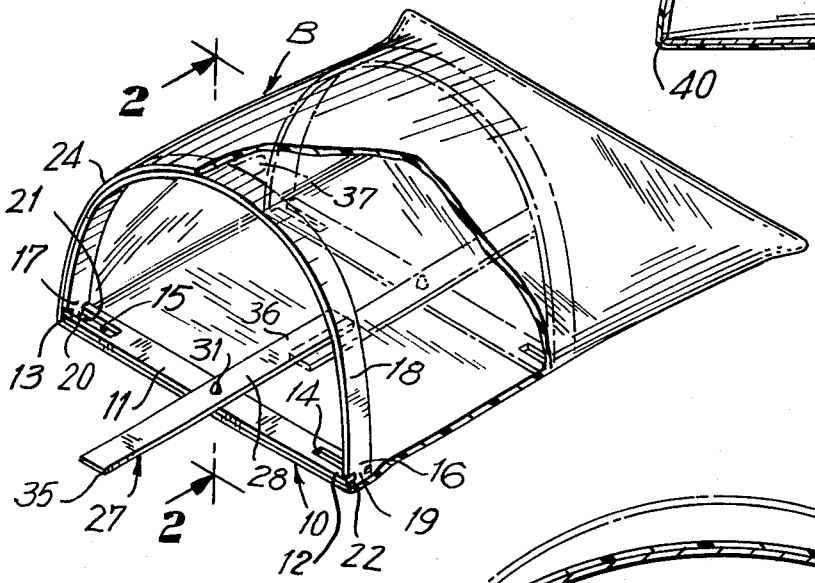
FIG. 1 is a perspective view, partially broken away, of a bag supported on a horizontal surface by an attachment mechanism in accordance with the invention.

Referring now to the drawings, there is shown in FIG. 1 a bag B supported in position to receive leaves or other detritus by a free-standing portable bag support 10 in accordance with the invention. The bag support apparatus comprises a base portion 11 which is preferably formed of an elongated rectangular length of rigid plastic material such as, by way of example, polypropylene.

The base portion 11 is provided adjacent the ends 12, 13 thereof with guide slots 14, 15, respectively, extending longitudinally inwardly from and opening at the ends 12, 13 of the base.

The slots 14, 15 form guides for the distal ends 16, 17 of a bail or stretcher member 18, the stretcher member being likewise made of resilient plastic or metal material, the stretcher 18 being of thinner stock than the base 11.

The distal ends 16, 17 of the stretcher 18 are provided with reduced neck portions 19, 20 of a size freely to pass through the slots 14, 15, the terminal ends of the stretcher 18 adjacent the neck portions being fitted with locking tabs 21, 22 which underlie the lower surface 23 of the base 11 in the areas adjacent the slots 14, 15, so as to prevent the ends of the stretcher from being lifted upwardly from the base once the necks 19, 20 are disposed within the slots 14, 15.

Due to the clearances provided between the respective portions of the slots and the necks, it will be appreciated that the stretcher 18 may be bowed to a greater or lesser curvature, with the neck portions engaged within the slots to vary, within a range, the size and configuration of the mouth portion defined between the base 11 and stretcher 18.

The bag member B is applied by outwardly lapping the open or receiving end 24 of the bag B over the base, bowing the stretcher 18 to a desired configuration while its ends are engaged within the slots, and then releasing the compressed stretcher portion such that the same snaps outwardly into tight engagement with the interior surfaces of the bag, whereby the bag is retained in position with its mouth distended by the outwardly expanding forces of the stretcher.

Figure 3:
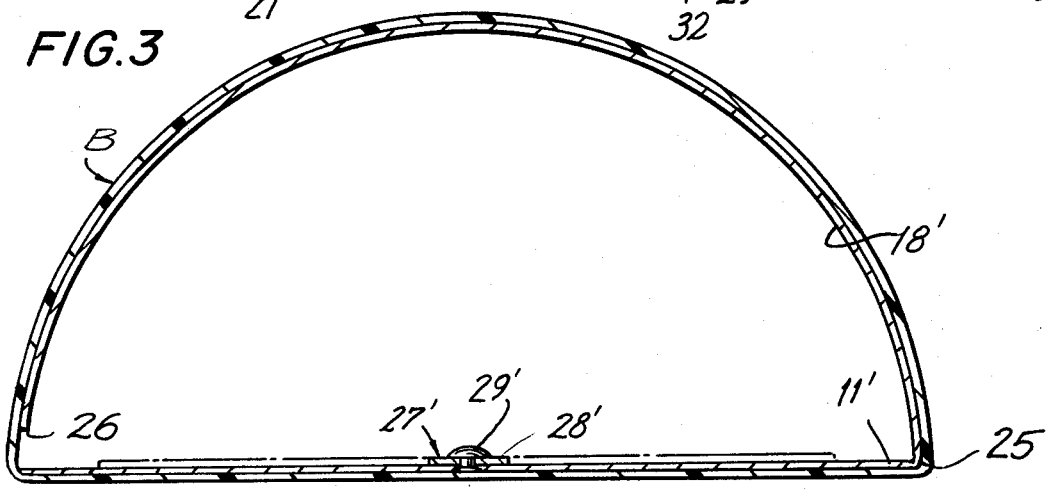
FIG. 3 is a section similar to FIG. 2 of a further embodiment of the invention.

It will be appreciated that the noted arrangement provides a degree of adjustability for the interior dimension of the bag, it being further understood that if bags of a given predetermined size only are to be employed and, consequently, adjustability is not a factor, the ends of the stretcher 18 may be simply permanently or temporarily anchored to the ends of the base plate without providing for lateral movement. Installation of the bag in such case is effected by bowing the stretcher downwardly toward the base plate to reduce the size of the mouth, sleeving the bag end over the depressed bowed portion and then releasing the stretcher.

Where a high degree of adjustability is required, the stretcher may take the form shown in FIG. 3, wherein like parts have been assigned like reference numerals. In the form of FIG. 3, the stretcher 18' is formed integrally with the base plate 11', the parts being hingedly connected by a thinned hinge portion 25. In this embodiment the stretcher 18' includes a free end portion 26 which, in the bag distending position thereof, is disposed in spaced relation to the base plate, the spacing and bowed configuration finally assumed by the stretcher 18' being a function of the perimeter size of the bag employed.

Figure 4:
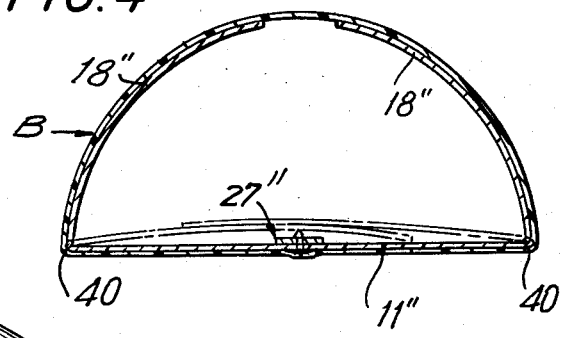
FIG. 4 is a section similar to FIG. 2 of a further embodiment of the invention, the section being shown in smaller scale.
Figure 2:
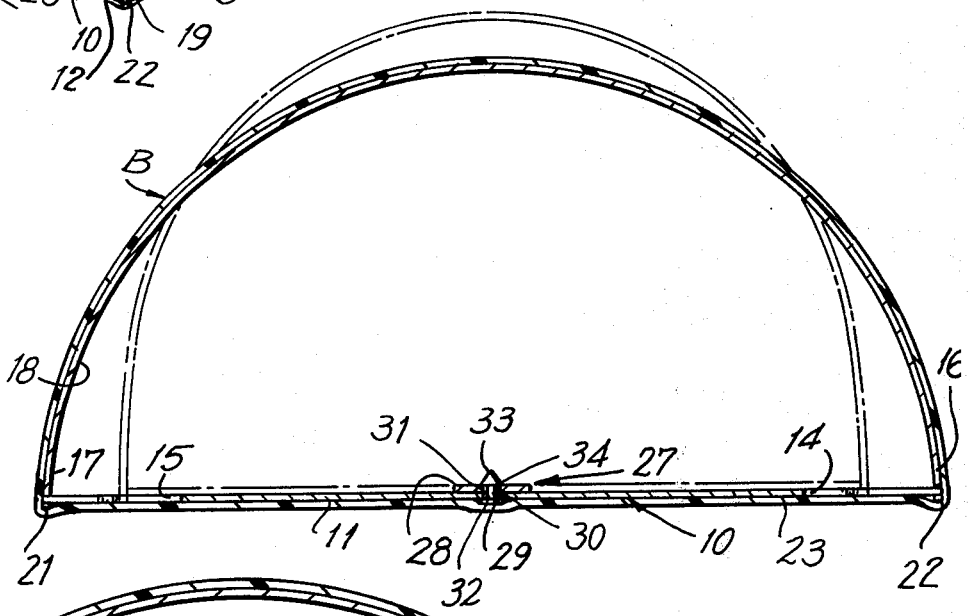
FIG. 2 is a vertical section taken on the line 2—2 of FIG. 1.

There is shown in FIG. 4 still a further variation of bag spreader and retainer mechanism. In accordance with this embodiment, a pair of spreader arms 18'' extend from the opposite ends 40, 40 of the base 11'', the arms 18'' and base being preferably formed of an integral resilient plastic sheet or molding. The arms 18'' normally tend to be disposed perpendicular to or in the plane of and outside the base 11'' but may be biased inwardly and downwardly toward or against the base. The device is used by pressing the arms 18'' close to the base assembly, inserting the apparatus into the bag, and then releasing the arms, which will spring upwardly and outwardly to the solid line position and retain and spread the bag. The embodiment of FIG. 4 has the advantage of being adaptable to receive a wide size range of bags and of being readily collapsed to a flat configuration for shipping by simply forcing the arms against the base.

It will be appreciated that various other stretcher arrangements for maintaining the bag in tautened relation over the base plate will readily occur to those skilled in the art in the light of applicant's disclosures, and no claim is made to the concept of providing a bag distending stretcher per se, the functional importance of the stretcher arrangement being to retain the bag in position and to maintain the mouth of the bag open while at the same time preventing any significant tilting between the stretcher and the base plate, i.e., the plane of the opening should be retained normal or substantially normal to the plane of the base plate.

An important feature of the invention resides in the support blade assembly 27 next to be described.

The blade assembly, in accordance with illustrated embodiments, comprises an elongate rectangular strip 28, preferably of plastic material of substantial rigidity. The blade 28 is pivotally connected to the base plate 11 by a vertically extending pivot pin 29 which may be integrally molded into the base plate 11, or may comprise a separate element passed through registering apertures 30, 31 in the base plate and blade member, 11 and 28 respectively.

The pivot pin 29 includes a headed portion 32 which underlies the base plate 11 or, if desired, the head may be seated within a recess in the base plate so as not to cause the base plate to be spaced from a ground support surface on which it is seated for applications where a space is counter-indicated, i.e., collecting dust from a floor surface. The upper end 33 of the pivot pin 29 may optionally be formed in a conic configuration leading to a downwardly facing annular retainer shoulder 34, the conic configuration permitting the pin 29 to be snapped through the apertures 30, 31 in the base plate 11 and blade 28.

It will be appreciated from the foregoing that the pivot pin 29 which passes substantially centrally through the base plate and blade pivotally connects the aforesaid members for relative rotary movement in a horizontal plane about the vertical axis of the pivot pin.

After the bag has been attached over the stretcher assembly and base plate in the manner aforesaid, the device is placed in operative position by rotating the blade member 28, preferably through an angle of about 90°, such that a first portion 35 of the blade extends externally of the bag whereas a second portion 36 extends internally into the bag. The interfit of the pin 29 with the base plate and blade is desirably such that relative rotation of the parts is frictionally restrained.

With the blade 28 rotated to the operative position shown in FIG. 1, the assembly 10 carrying bag B may be seated on a horizontal surface, such as a lawn, driveway, floor or the like, and leaves, grass clippings, trash or the like may be swept through the open end 24 of the bag into the interior thereof.

It will be observed that portions 35 and 36 of the blade extend both within and without the bag. The assembly 10 is thus prevented from tilting in any direction, e.g., is retained in its desired vertical position.

A significant advantage of the blade assembly described lies in the fact that, in the operative position, portions of the blade are disposed inside the bag and prevent the bag, and particularly the ground adjacent portions of the bag, from inwardly lapping and consequently blocking the open mouth portion of the bag.

Optionally, the stretcher member 18, at an essentially medial portion, may be provided with an inwardly projecting portion 37 which will function to prevent the uppermost parts of the bag from drooping downwardly into the path of the mouth.

From the foregoing it will be appreciated that there is described and illustrated a portable bag distending apparatus on which may be mounted vinyl or like bags, the distending apparatus permitting the bag, without manual attention, to be retained on a horizontal surface with its mouth held open for the receipt of leaves, grass clippings or like detritus. The stretcher or stretcher members fixed to the base plate permit the apparatus to be accommodated to bags of a wide variety of sizes, it being understood that where the unit will be used for a great range of bag sizes, the embodiment of FIG. 4 is preferred.

The novel blade support assembly in the defined combination provides the double function of affording support against tilting inwardly or outwardly without the use of stakes, and providing a bag extending or distending feature, as more fully set forth hereinabove.

A further desirable feature of the instant apparatus lies in its ability to be sleeved to an intermediate position within the bag, such that the portion of the bag nearest the sealed end may be filled, and thereafter the unit moved outwardly within the bag toward the open end, enabling full utilization of the capacity of the bag by preventing the formation of internal pockets. The ability of the apparatus to be sleeved completely within the bag is the result of the absence of any protrusions, handles, operating mechanisms and the like associated with prior art bag supports, which would preclude such prior art supports from being disposed entirely within the bag.

It will be further appreciated that the bag support, in its simplest form or forms, is comprised of three basic components, namely, the base plate, the stretcher member or members integral with or attachable to the base plate, and the blade support pivotally mountable on an attachment pin molded into or secured to the base plate. It will thus be seen that the normally substantially flat base plate, stretcher and blade may be packaged in an extremely small space, and readily assembled and disassembled.

Having thus described the invention and illustrated its use, what is claimed as new and and desired to be secured by Letters Patent is:

1. A portable free-standing bag distender apparatus comprising a rigid, flat, elongated, horizontal base plate, a generally planar elongated support blade adjacent and parallel to said base plate, said blade being essentially free of portions extending out of the plane of said blade, pivot means connecting said base plate and support blade for relative angular movement about a pivot axis perpendicular to the planes of said plate and blade, said pivot extending through said blade at a substantially medial position relative to the longitudinal axis of said blade whereby, when said blade is rotated about said pivot axis to offset the longitudinal axes of said plate and blade by 90°, portions of said blade extending to both sides of said plate, and stretcher means mounted on said blade, said stretcher means being resiliently deformable in a plane above and normal to said plate and blade, said stretcher means and plate together defining an open mouth expansible in a vertical plane and adapted to retain in open position thereover the vertically arrayed receiving end of a bag by expansion against the interior of said bag.

2. Apparatus in accordance with claim 1 wherein said base plate and said stretcher means comprise an integral resilient plastic element.

3. Apparatus in accordance with claim 1 wherein said stretcher means comprises first and second arm members extending from the ends of said base plate, said arm members being shiftable between a collapsed position in which said arms lie parallel to the plane of said base plate, to a bag retaining position wherein said arms are disposed above said plate.

4. Apparatus in accordance with claim 1 wherein said stretcher means is formed of resilient plastic material which is substantially flat in the relaxed condition thereof, said stretcher means being deformed to an arcuate configuration in the bag retaining position thereof.

5. Apparatus in accordance with claim 4 wherein one end of said stretcher means is hingedly connected to one end of said plate.

6. Apparatus in accordance with claim 4 wherein the distal ends of said stretcher means are slidably connected to the distal ends of said plate.

7. Apparatus in accordance with claim 1 wherein said pivot means includes a snap connector member adapted to connect said blade and base plate responsive to movement of said blade toward said plate.

8. Apparatus in accordance with claim 7 wherein said snap connector member is integrally formed on said plate.

9. A portable free-standing bag distender apparatus adapted to support a plastic trash bag or the like in distended condition on a horizontal surface with the receiving end of said bag in the open condition above said horizontal surface and with at least certain portions of said bag inwardly of said receiving end extending in a direction lengthwise of said bag, comprising a base assembly including a thin, rigid, planar base portion adapted to rest on a horizontal surface, a generally planar stabilizer blade immediately adjacent and parallel to said base, said blade being pivotally connected to said base intermediate its ends for angular movement relative to said base in a plane parallel to the plane of said base, said blade being shiftable in said angular direction between an aligned position with said base and an offset position, said blade, in said offset position, including portions lying to either side of said base, and yieldingly expansible bag stretcher means mounted on said blade assembly, said stretcher means being movable in a plane normal to the plane of said base, said stretcher means defining with said base assembly an outwardly expanding open mouth portion adapted to be inserted within the receiving end of a bag, said bag being retained over and caused to conform to the configuration of said open mouth by outward pressures exerted against the inside of said bag by said expansible stretcher means.

* * * * *